US010897985B2

(12) United States Patent
Kim

(10) Patent No.: US 10,897,985 B2
(45) Date of Patent: Jan. 26, 2021

(54) COMBINATION MASCARA BRUSH

(71) Applicant: AA R&D LLC, Leonia, NJ (US)

(72) Inventor: Aiden T. Kim, Leonia, NJ (US)

(73) Assignee: AA R&D LLC, Leonia, NJ (US)

( * ) Notice: Subject to any disclaimer, the term of this patent is extended or adjusted under 35 U.S.C. 154(b) by 211 days.

(21) Appl. No.: 15/843,950

(22) Filed: Dec. 15, 2017

(65) Prior Publication Data

US 2018/0168324 A1 Jun. 21, 2018

Related U.S. Application Data

(60) Provisional application No. 62/435,916, filed on Dec. 19, 2016.

(51) Int. Cl.

| | |
|---|---|
| ***A45D 40/26*** | (2006.01) |
| ***A46B 9/02*** | (2006.01) |
| ***A46B 9/06*** | (2006.01) |

(52) U.S. Cl.

CPC ..... *A46B 9/021* (2013.01); *A46B 9/026* (2013.01); *A46B 9/06* (2013.01); *A46B 2200/106* (2013.01)

(58) Field of Classification Search

CPC ..... A45D 40/262; A45D 2200/10; A45D 2200/106; A46B 7/02; A46B 7/042; A46B 7/044; A46B 9/02; A46B 9/021; A46B 9/026; A46B 9/06; A46B 2200/106

USPC ..... 132/218

See application file for complete search history.

(56) References Cited

U.S. PATENT DOCUMENTS

| | | | | |
|---|---|---|---|---|
| 6,408,857 | B1 | 6/2002 | Neuner | |
| 2008/0011317 | A1 | 1/2008 | Malvar et al. | |
| 2009/0014022 | A1 | 1/2009 | Salciarini | |
| 2010/0037911 | A1 * | 2/2010 | Kim | A45D 40/262 132/218 |

(Continued)

FOREIGN PATENT DOCUMENTS

| | | | |
|---|---|---|---|
| EP | 0 635 222 | A2 * | 8/1993 |
| FR | 2905243 | * | 7/2008 |

(Continued)

OTHER PUBLICATIONS

International Search Report dated Mar. 8, 2018, issued in counterpart International Application No. PCT/US17/66987. (9 pages).

(Continued)

*Primary Examiner* — Rachel R Steitz

(74) *Attorney, Agent, or Firm* — Westerman, Hattori, Daniels & Adrian, LLP

(57) ABSTRACT

The present invention is directed to a cosmetic applicator brush comprising a plurality of columns, and a shaft. The shaft comprises a plurality of opening parts around a circumference of the shaft, and the plurality of opening parts are spaced around the circumference in a radial direction of the shaft. Each of the plurality of columns comprises bristles or combs. Each of bristles or combs has a projecting part, which are inserted into the plurality of columns with an equal distance or different distances among them. A number of the plurality of opening parts around the circumference of the shaft is both even and odd number. The plurality of columns are inserted into the opening parts of the shaft irregularly to show the zigzag effect of the cosmetic applicator brush.

11 Claims, 12 Drawing Sheets

(56) References Cited

U.S. PATENT DOCUMENTS

| | | | | |
|---|---|---|---|---|
| 2011/0164914 | A1* | 7/2011 | Caulier | A46B 3/18 401/129 |
| 2011/0258798 | A1* | 10/2011 | Naftal | A46B 3/00 15/176.6 |
| 2011/0297174 | A1 | 12/2011 | Ornoski et al. | |
| 2011/0297175 | A1 | 12/2011 | Pires et al. | |
| 2014/0105667 | A1 | 4/2014 | Castex et al. | |
| 2014/0246043 | A1 | 9/2014 | Befve et al. | |
| 2015/0335133 | A1 | 11/2015 | Kim | |

FOREIGN PATENT DOCUMENTS

| | | | |
|---|---|---|---|
| JP | 2009-125160 | A | 6/2009 |
| JP | 2012-75723 | A | 4/2012 |
| KR | 10-2012-0026121 | A | 3/2012 |

OTHER PUBLICATIONS

Office Action dated May 27, 2020, issued in counterpart EP application No. 17882539.4. (12 pages).

Office Action dated Jun. 28, 2020, issued in counterpart KR application No. 10-2019-7014895, with English translation. (13 pages).

Office Action dated Aug. 11, 2020, issued in counterpart JP application No. 2019-527204, with English translation. (7 pages).

Extended (Supplementary) European Search Report dated Dec. 8, 2020, issued in counterpart EP Application No. 17882539.4. (11 pages).

* cited by examiner

COMBINATION MASCARA BRUSH

RELATED APPLICATION

This application claims priority to U.S. Provisional Application No. 62/435,916, "ZIGZAG AND HYBRID MASCARA BRUSH," filed Dec. 19, 2016, which application is incorporated by reference herein in its entirety.

FIELD OF THE INVENTION

The present invention relates to a cosmetic applicator. More particularly, the present invention relates to a cosmetic applicator brush, which is capable of aligning lateral protrusions irregularly for increased performance capabilities for customers.

BACKGROUND OF THE INVENTION

Various cosmetics are applied using an applicator brush, for example, mascara which is a kind of cosmetic that is mainly used by women. The applicator brush is a cosmetic tool for painting various colors of mascara on eyelashes in order to show aesthetic sense around eyes or for applying other cosmetics to the eyes or other areas.

With the exemplary mascara, the applicator brush is configured to be inserted into a vessel, in which mascara liquid is stored and comprises a knob for opening and closing the vessel, a shaft protruded to a leading end of the knob, and a brush formed on the shaft. The mascara is used by smearing the mascara liquid on the brush through the coupling or separate process of the knob and the vessel.

Meanwhile, the mascara brush formed as above is manufactured to be suitable for various functions, such as a volume for the eyelashes (volume: effect that eyebrows are seen to be affluent according to the length and form of the brush hair), curl (curl: an effect that a length of eyebrows is long), clean (clean: an effect that eyebrows are not lumped), etc. The mascara brush uniformly applies the mascara liquid having viscosity on the eyelashes and a combing function by the brush should be excellent so that the eyelashes are not coagulated.

One type of manufacture for mascara brushes is a disc brush which is manufactured with an axial shaft that is penetrating multiple discs at the center. In order to create a desired bristle arrangement, each successive disc is placed in angular offset compared to the disc before and after. To achieve the angular offset, a geometrical cross section or key is typically built into the shaft and discs alike. Such a keyed system requires the key to be offset relative to the bristles a different amount for each disc.

However, in the conventional mascara brushes (injection-molded mascara brushes), the alignment of bristles is uniform in both horizontal and vertical directions of an axial shaft, and the number of bristles in a horizontal (or vertical) direction of an axial shaft is always an even number because of its manufacturing method. That is, the alignment of bristles is limited, and the mascara liquid does not smear on the brush sufficiently. Consequently, make-up performance of the conventional mascara brushes is not great as the mascara liquid would not be able to smear on the brush sufficiently, thereby producing inferior make-up performance.

Therefore, the objective of the present invention is to provide an improved method of producing the mascara brushes so that they have better make-up performance compared to the conventional mascara brushes and have various designs available to the users. For example, the present invention provides a cosmetic applicator, which includes columns with comb as well as bristles of different colors and alignment configurations. That is, the present invention provides a "hybrid" and "zigzag"-type cosmetic applicator, which can be produced with the conventional manufacturing methods based on the user's different needs.

SUMMARY OF THE INVENTION

In at least one embodiment, the present invention provides a cosmetic applicator brush, in which columns of its lateral protrusions such as bristles or combs are inserted into opening parts of a shaft. For each column, bristles or combs are spaced apart with an equal distance or different distances among them. The opening parts of the shaft are equally (or differently) spaced around the shaft in a radial direction of the shaft. Each lateral protrusion (bristles or combs or etc.) has a projecting part with the same shape/different shapes, and each column consists of bristles or combs or toothbrushes, which are inserted into each column.

In at least one embodiment, the present invention provides a cosmetic applicator brush, in which columns of its lateral protrusions such as bristles or combs are stacked with each other without the shaft. Each lateral protrusion has the projection part with the same shape/different shapes, and each column consists of bristles or combs or toothbrushes, which are inserted into each column.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings:

FIGS. 1A-1H consist of views of the shaft with the opening parts, the column with bristles/combs and the projecting part, and the cosmetic applicator, where columns are irregularly aligned.

FIGS. 2A-2F consist of views of the column with bristles/combs and the projecting part, and the cosmetic applicator, where columns are irregularly aligned without the shaft.

DETAILED DESCRIPTION OF THE INVENTION

Figure 1A:
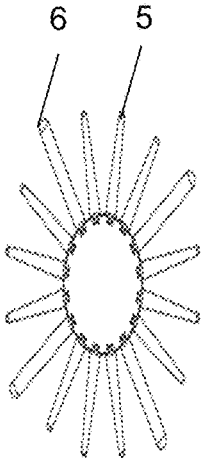
FIGS. 1A-1H are views of a cosmetic applicator brush utilizing irregular alignment of the lateral protrusions with the shaft in accordance with the first embodiment.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 1B:
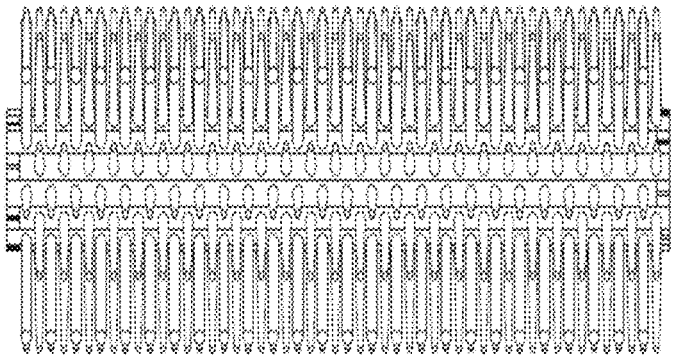
Figure 1G:
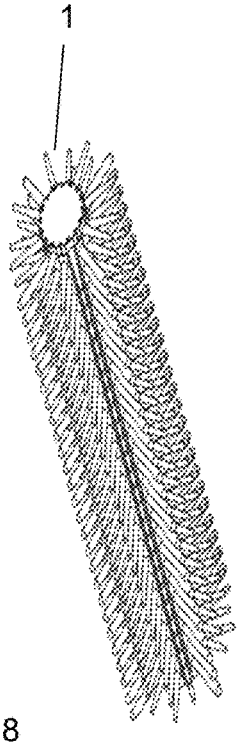
Figure 1C:
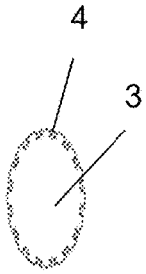
Figure 1D:
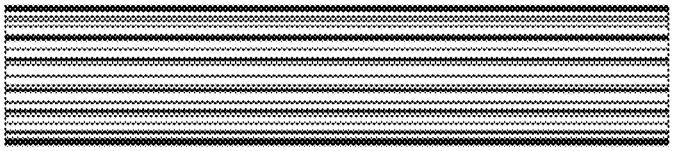
Figure 1E:
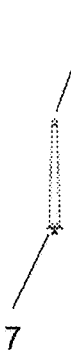
Figure 1F:
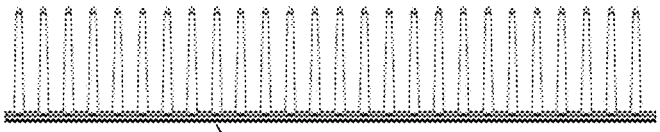
Figure 1H:
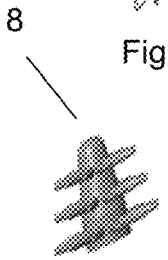

Referring to FIGS. 1A-1H, a cosmetic applicator brush 1 in accordance with the first embodiment of the invention will be described. The applicator brush 1 includes a plurality of columns 2 around a shaft 3. The shaft 3 has opening parts 4 around a circumference of the shaft 3, and the opening parts 4 are equally/differently spaced around the circumference in a radial direction of the shaft. The number of the opening parts 4 can be any numbers (both even and odd numbers). Each column 2 consists of bristles 5 or combs 6, and each of the bristles 5 and combs 6 has a projecting part 7, which is inserted into each column 2. The bristles 5 or combs 6 are spaced apart with an equal distance or different distances on each column 2 among them.

Here, the shaft 3 can be of any size, shape (triangular, square, circular, oval, and etc.), color, material (plastic, metal, composite, and etc.). In addition, each column 2 consists of comb, bristle, or any type of protrusions of size (between 1-20 mm), shape (triangular, rectangular, polygonal, and etc.), color (grey, red, orange, and etc.) and materials (plastics, metals, nylon fibers, composites, and etc.). Each column 2 inserted into the shaft 3 are mono, bi, tri, quad columns of protrusion. The design of the projecting part 7 is not limited to the design shown in FIGS. 1A-1H. It is preferred that the design of the projecting part 7 is such that it can be securely inserted into each column 2.

The plurality of columns 2 are inserted into the opening parts 4 of the shaft 3 irregularly to show the zigzag effect of the applicator brush 1 to increase performance capabilities for customers. It is possible that a certain portion of the circumference of the shaft does not have any opening parts so that the plurality of columns 2 are not inserted. For example, the cosmetic applicator brush 1 in accordance with the first embodiment of the invention is superior in producing the effect of volumizing, curling, lengthening, and etc.

The cosmetic applicator brush 1 may include a conical 8, which is located at a top portion of the shaft 3. The design of the conical 8 is not limited to the design shown in FIGS. 1A-1H. The conical 8 prevents the plurality of columns 2 from moving from the shaft 3 and ensures the secure alignment with the shaft 3. The conical 8 can be manufactured with the shaft 3 as one body or can be manufactured separately after the assembly.

The cosmetic applicator brush 1 may not include a conical 8 and may be designed such that the top portion of the shaft 3 is tapered toward the end of the shaft 3.

Figure 2A:
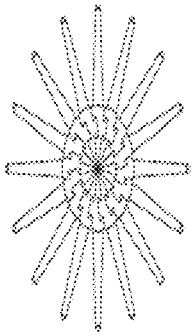
FIGS. 2A-2F are views of a cosmetic applicator brush utilizing irregular alignment of the lateral protrusions without the shaft in accordance with the second embodiment.
Figure 2B:
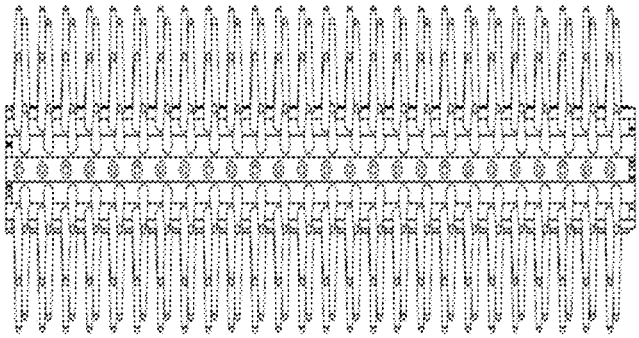
Figure 2E:
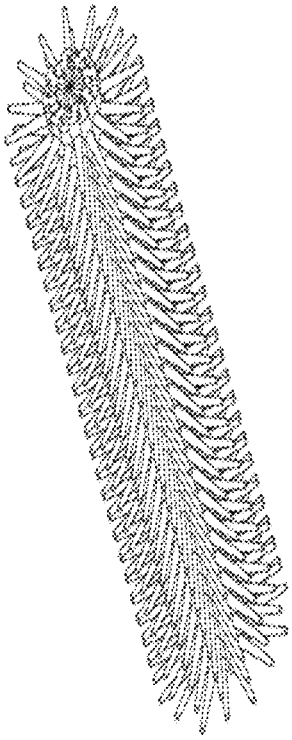
Figure 2C:
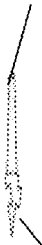
Figure 2D:
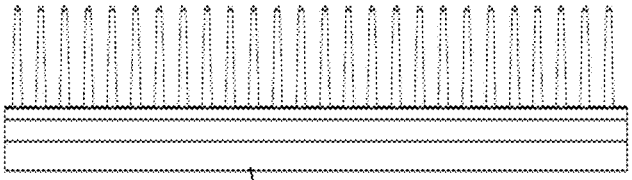
Figure 2F:
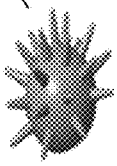

Referring to FIGS. 2A-2F, the cosmetic applicator brush 1' in accordance with the second embodiment of the invention will be described. The main difference between the first and the second embodiments of the invention is that the second embodiment of the invention does not have the shaft. The applicator brush 1' includes a plurality of columns 2'. The plurality of columns 2' are stacked such that the applicator brush 1' becomes a circular (or any shape) shape in a radial direction of the applicator brush 1'. Each column 2' consists of bristles 5' or combs. Each of the bristles 5' and combs has the projecting part 7', which is inserted into each column 2'. The bristles 5' or combs are spaced apart with an equal distance or different distances on each column 2' among them.

Similar to the first embodiment of the invention, in the cosmetic applicator brush 1' in accordance with the second embodiment of the invention, the plurality of columns 2' are stacked irregularly to show the zigzag effect of the applicator brush 1' to increase performance capabilities for customers. It is possible that a certain number of columns do not have any bristles 5' or combs. For example, the cosmetic applicator brush 1' in accordance with the second embodiment of the invention is superior in producing the effect of volumizing, curling, lengthening, and etc.

In FIGS. 2A-2F, the projecting parts 7' are superimposed to form the shaft shown in FIGS. 1A-1H. The superimposed projecting parts 7' can take shape of circle, square, triangle, and etc. The projecting parts 7' can be superimposed onto one another by means of locking method, mechanical method, or procedures during assembly (glue, laser, heat, nail, staple, and etc.). The projecting parts 7' do not need to be leveled when superimposed to form an irregularity of protrusions when viewed laterally to form the zigzag effect. The projecting parts 7' composed of protrusions are manufactured by means of plastic injection molding, laser insertion (toothbrush bristles), glue, heat, staples, and etc. The design of the projecting part 7' is not limited to the design shown in FIGS. 2A-2F. It is preferred that the design of the projecting part 7' is such that it can be securely inserted into each column 2'.

The cosmetic applicator brush 1' may include a conical 8', which is located at a top portion of the cosmetic applicator brush 1'. The design of the conical 8' is not limited to the design shown in FIGS. 2A-2F. The conical 8' prevents the plurality of columns 2' from moving among each other and ensures the secure positioning of the plurality of columns 2'. The conical 8' can be manufactured separately after the assembly.

The cosmetic applicator brush 1' may not include a conical 8' and may be designed such that the top portion of the applicator brush 1' is tapered toward its end.

Figure 3A:
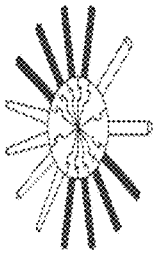
FIGS. 3A-12C show various examples of a cosmetic applicator brush utilizing irregular alignment of the lateral protrusions without the shaft in accordance with the second embodiment.
Figure 3B:
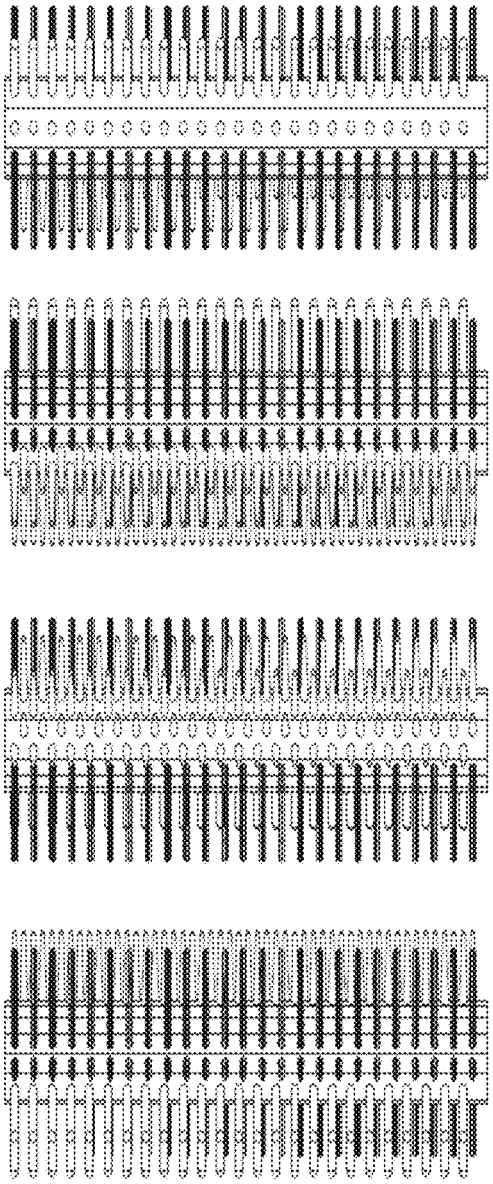
Figure 3C:
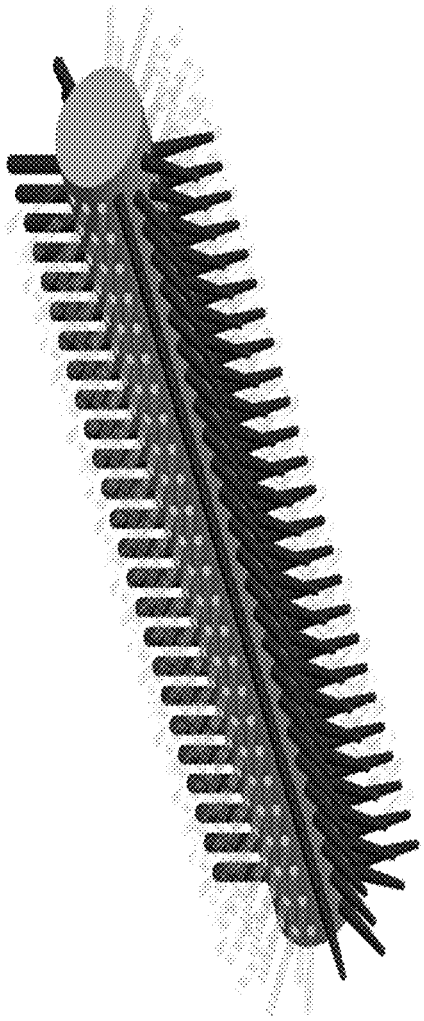
Figure 4A:
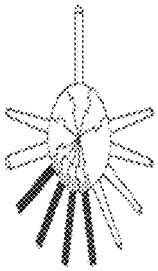
Figure 4B:
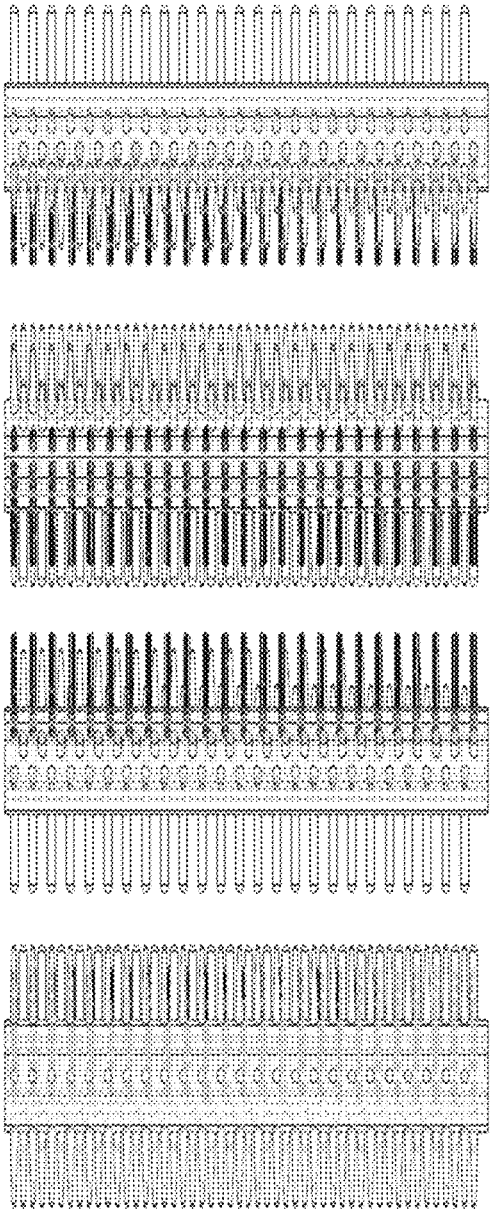
Figure 4C:
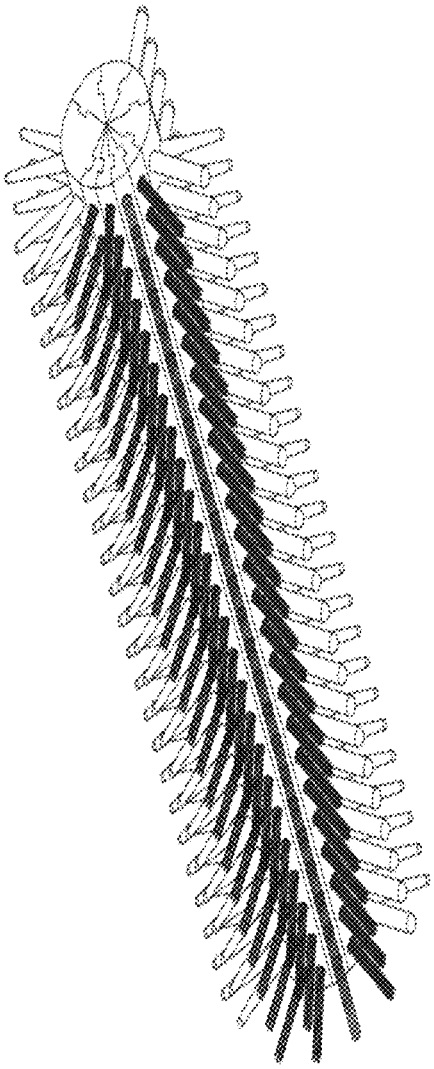
Figure 5A:
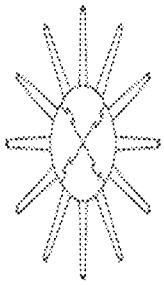
Figure 5B:
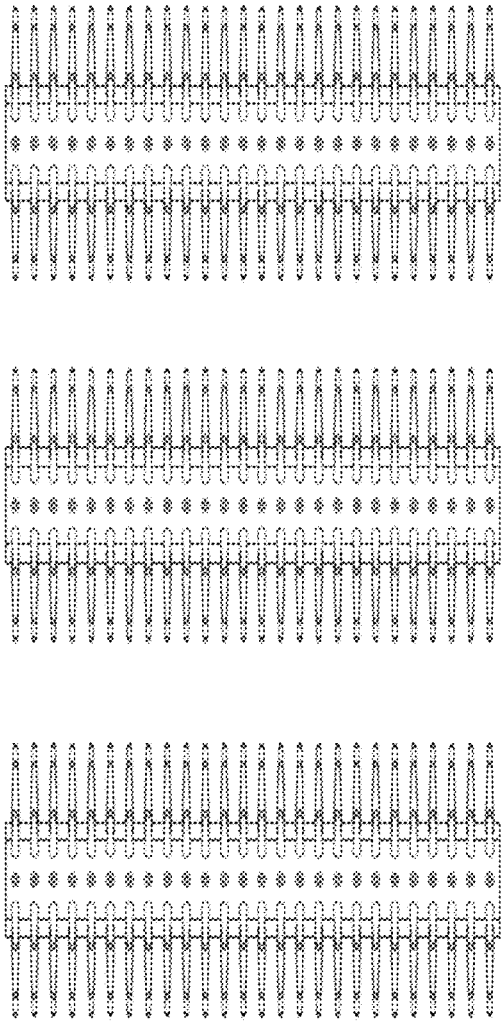
Figure 5C:
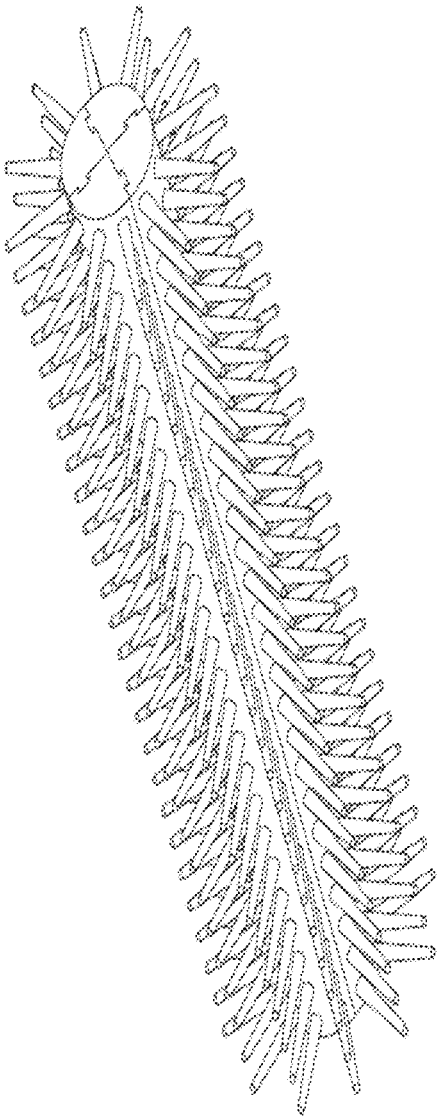
Figure 6A:
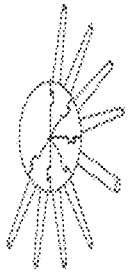
Figure 6B:
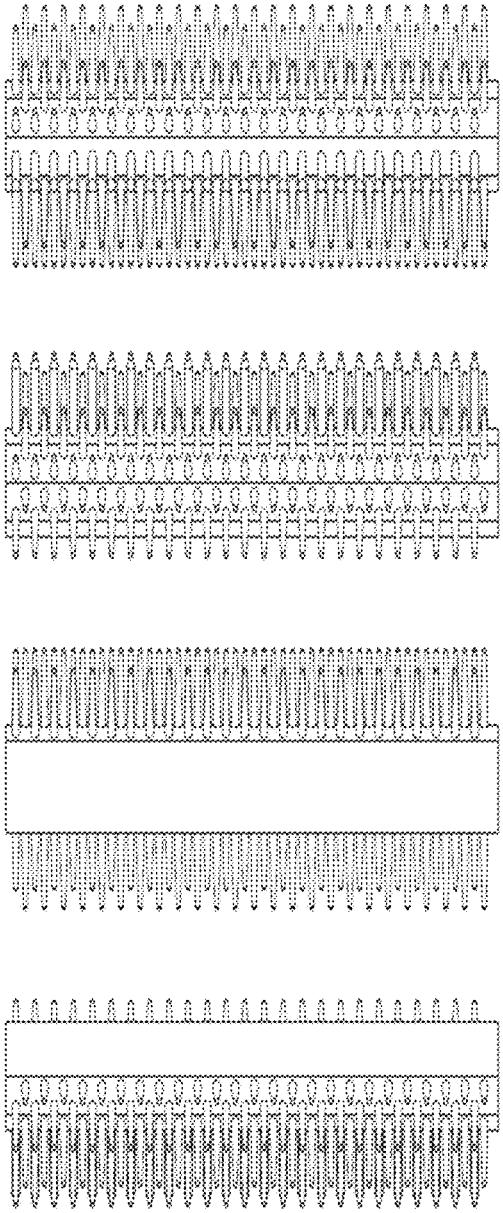
Figure 6C:
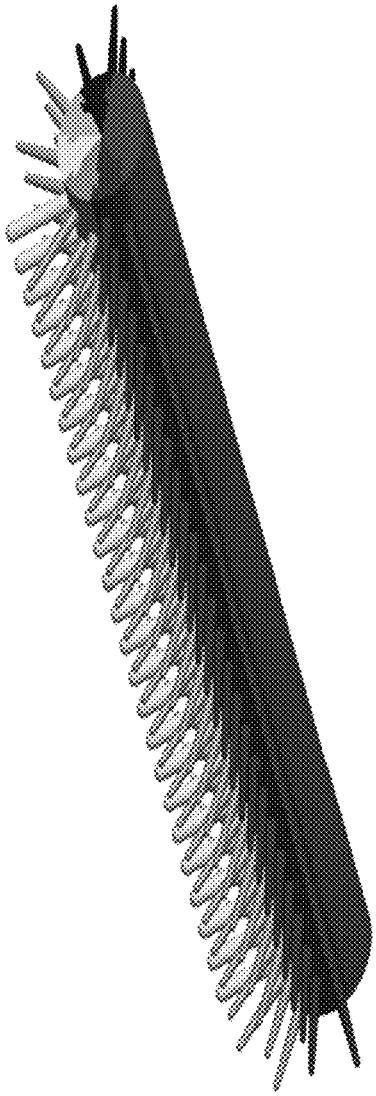
Figure 7A:
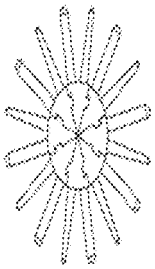
Figure 7B:
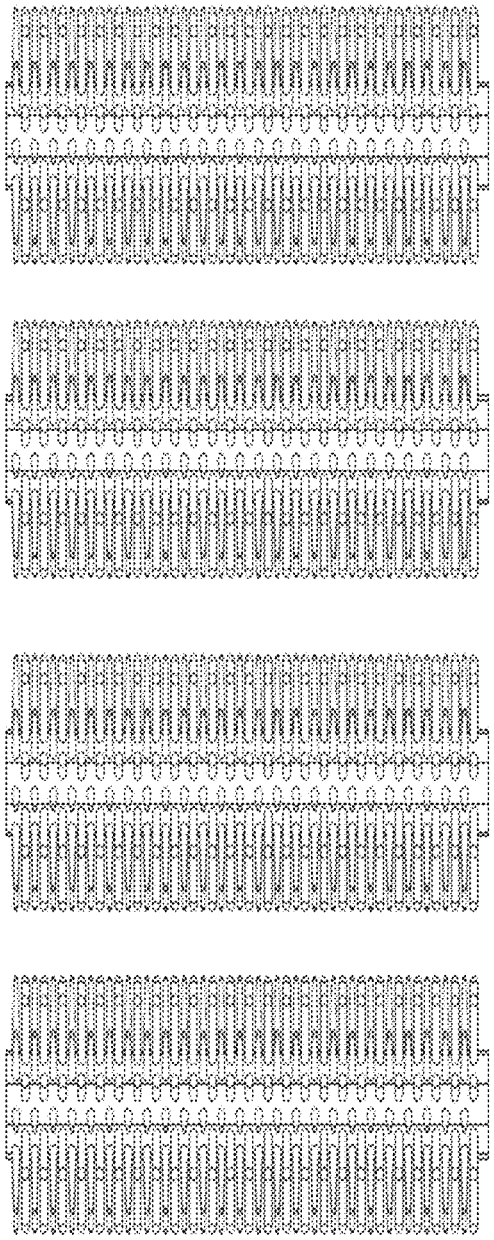
Figure 7C:
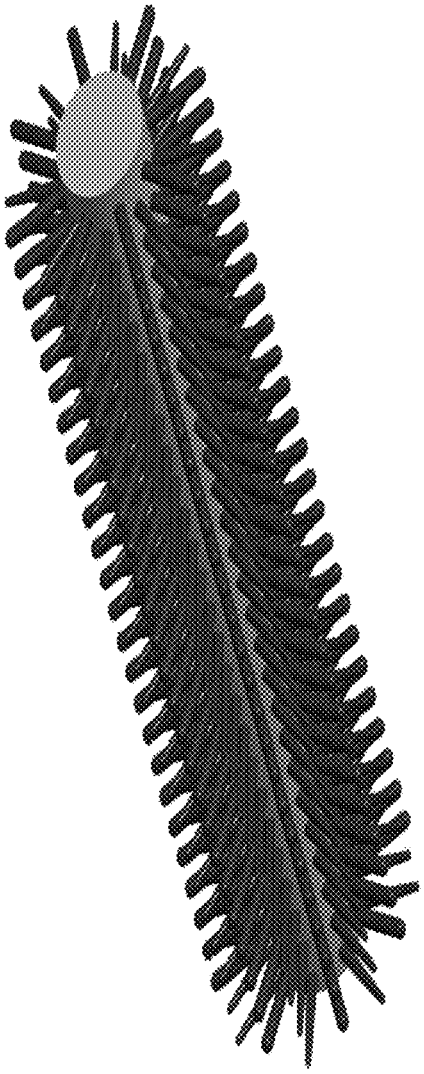
Figure 8A:
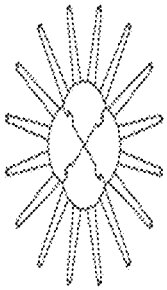
Figure 8B:
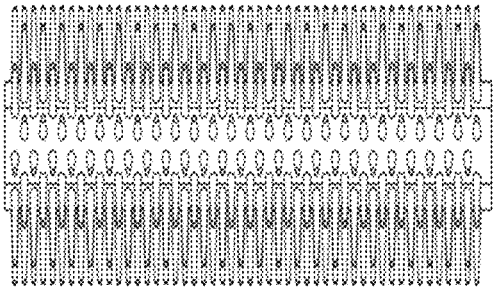
Figure 8B:
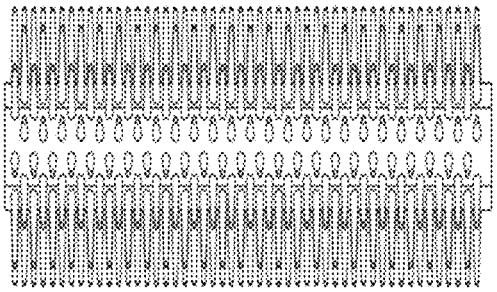
Figure 8C:
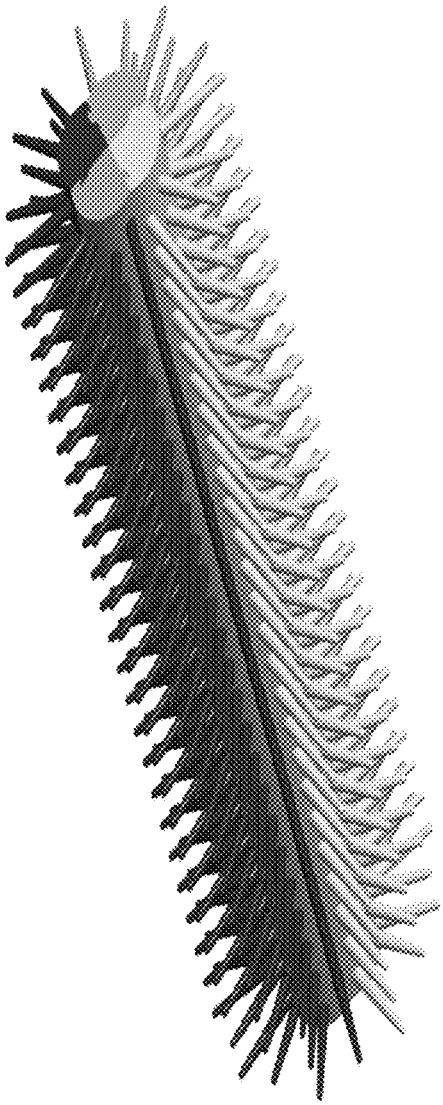
Figure 9A:
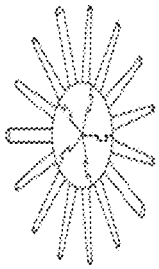
Figure 9B:
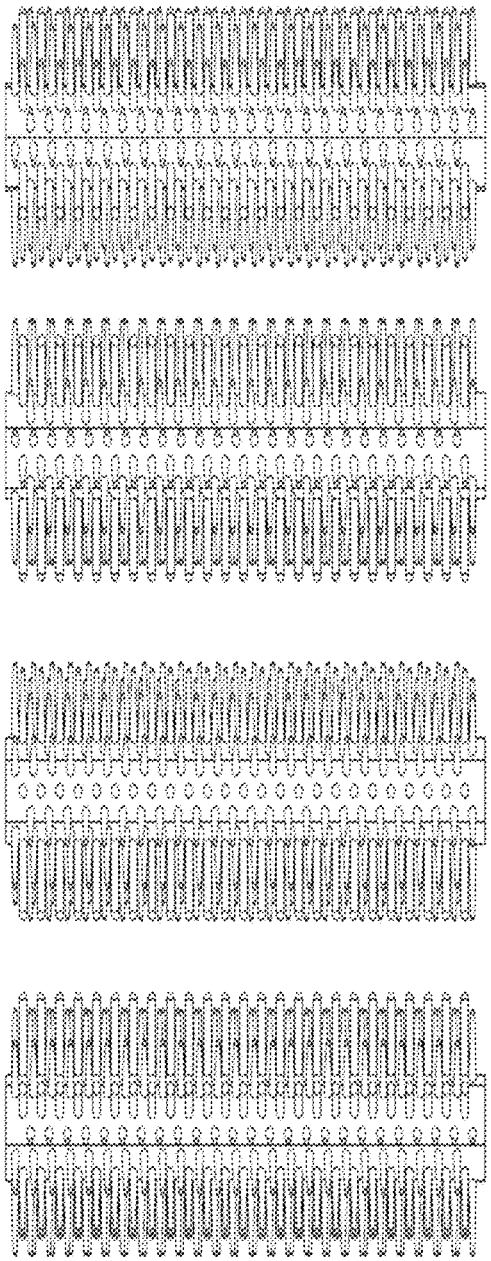
Figure 9C:
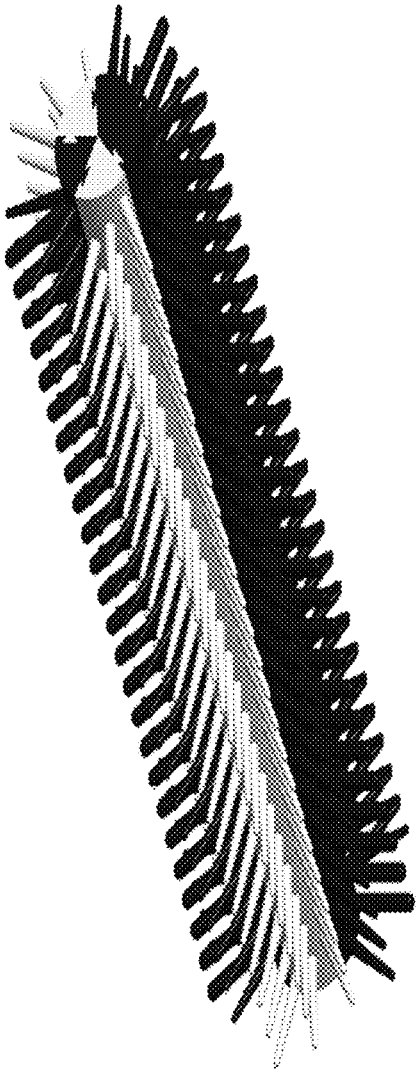
Figure 10A:
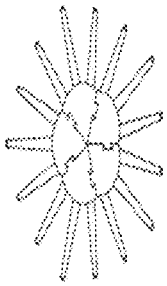
Figure 10B:
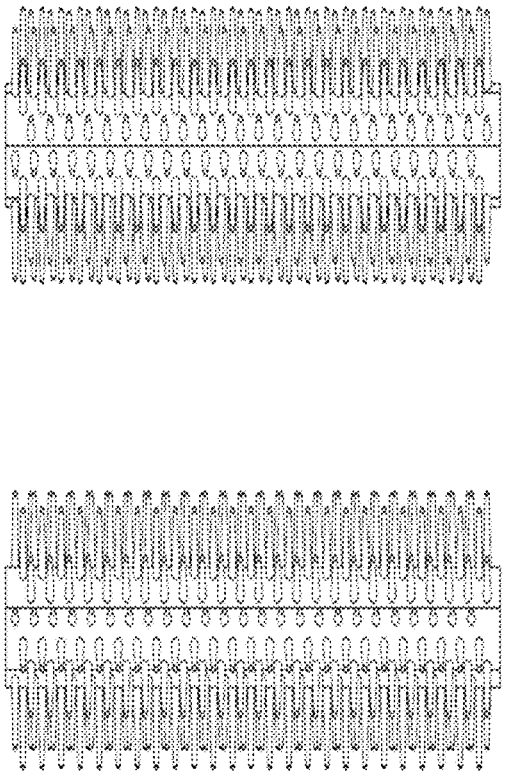
Figure 10C:
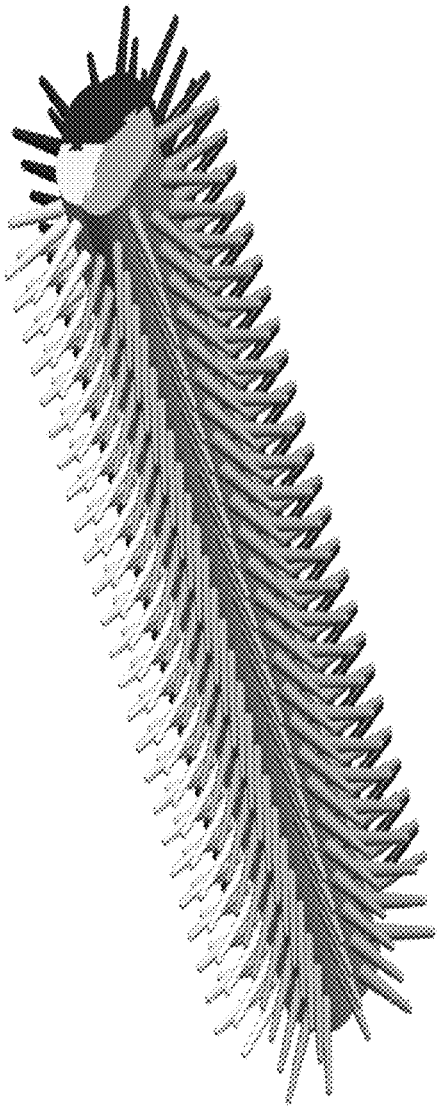
Figure 11A:
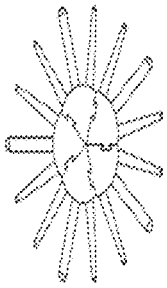
Figure 11B:
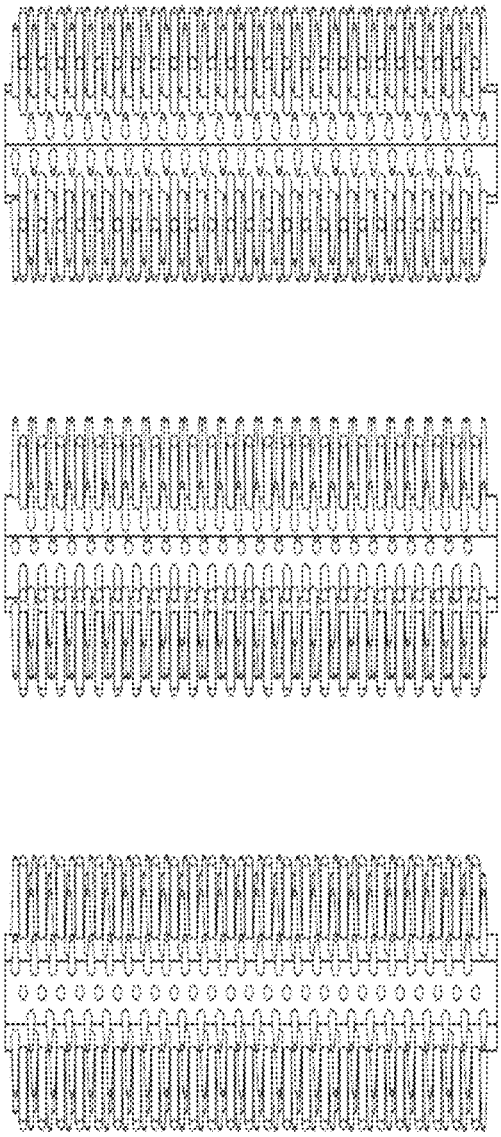
Figure 11C:
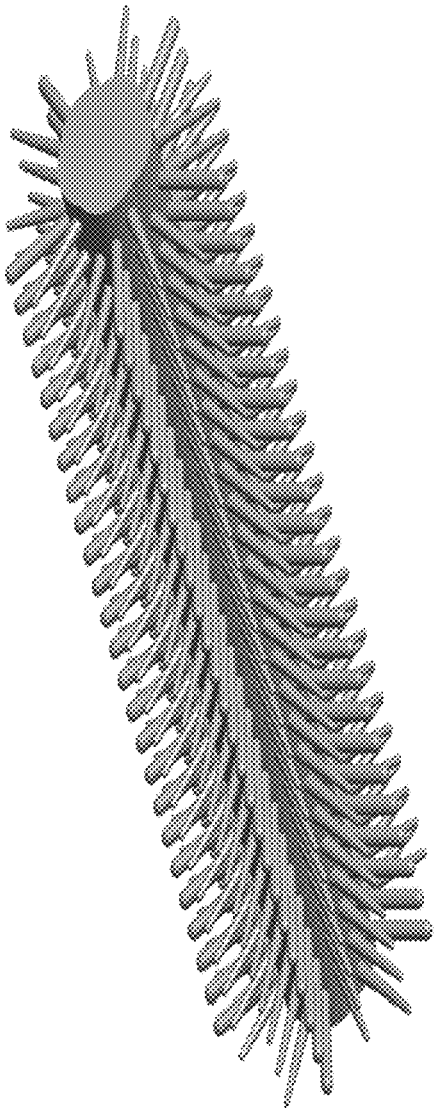
Figure 12A:
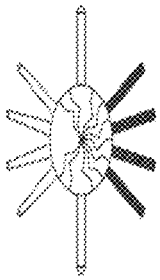
Figure 12B:
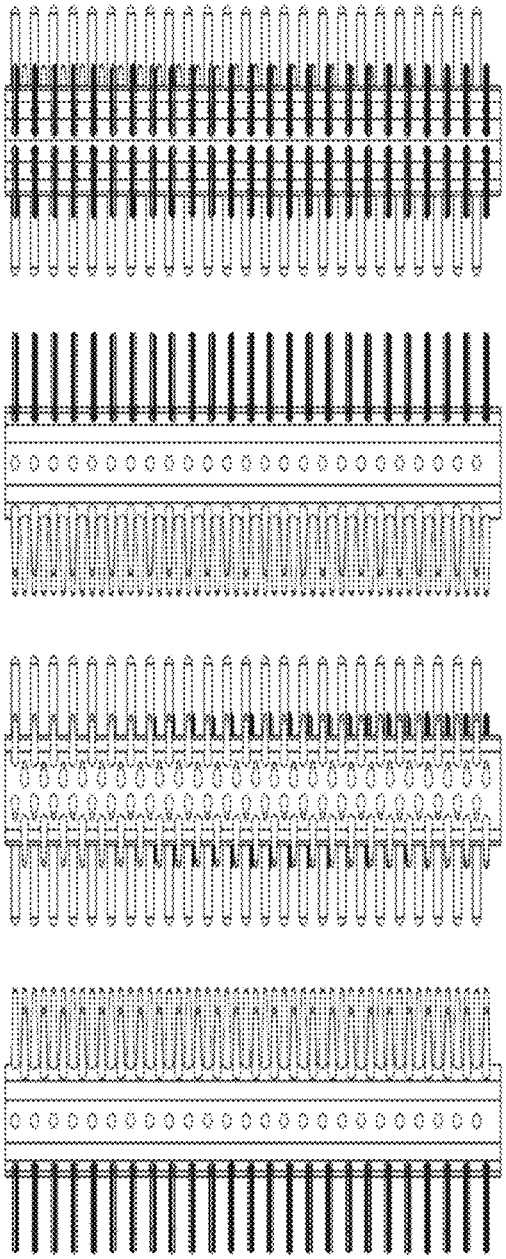
Figure 12C:
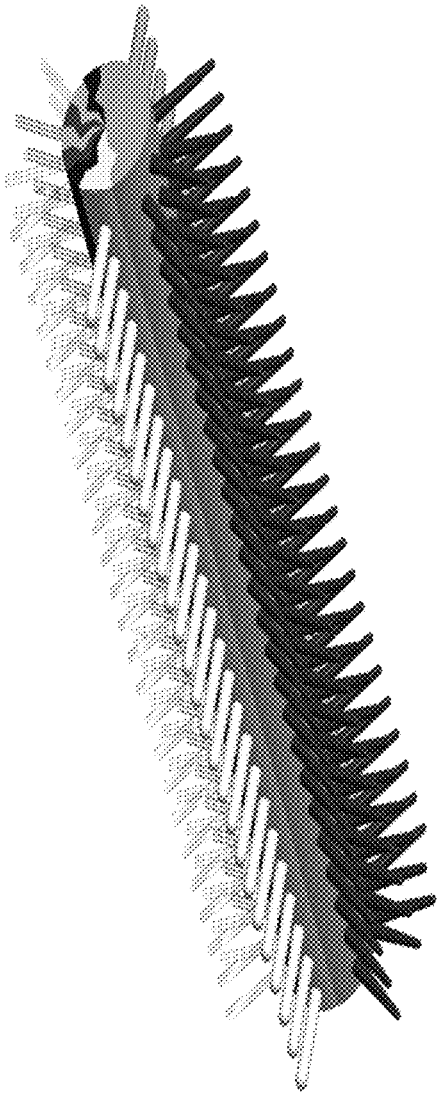

FIGS. 3A-12C show various examples of a cosmetic applicator brush utilizing irregular alignment of the lateral protrusions without the shaft in accordance with the second embodiment.

The advantages of the present invention will be apparent to those skilled in the art from the foregoing specification.

For example, the present invention provides the cosmetic applicator, which is not limited to only symmetrical units. The present invention provides the cosmetic applicator, where each column or bristles/combs is not limited to a single color. Instead, the present invention provides the cosmetic applicator with various color combinations/patterns, creating a visually attractive cosmetic brush. Furthermore, the present invention provides the cosmetic applicator, which is capable for performing various functions depending on the needs of the customers based on choice of shape, size, and material for each column. For example, the cosmetic application may have each column with different characteristics such as comb, long bristles, short bristles, toothbrushes and etc.

In addition, the present invention provides the cosmetic applicator, which can be manufactured by automated plastic assembly techniques such as welding (ultrasonic, vibration, laser, spin, infrared, hotplate, thermal), mechanical methods, stapling, nail, gluing, over molding, bi-injection, vertical type injection molding, and etc. Therefore, it is possible to produce the cosmetic applicator economically and efficiently to meet the needs of the customers.

Furthermore, the present invention provides the cosmetic applicator, which is capable of aligning the columns with the bristles/combs irregularly, and therefore, the mascara liquid can be uniformly applied and stored.

Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A cosmetic applicator brush comprising:

a plurality of columns; and a shaft, wherein the shaft comprises a plurality of opening parts around a circumference of the shaft, the plurality of opening parts being spaced around the circumference in a radial direction of the shaft, each of the plurality of columns comprises bristles or combs, a size of each of the plurality of columns in a direction perpendicular to the radial direction of the shaft is greater than a size of each of the plurality of columns in the radial direction of the shaft, and the plurality of columns are inserted into the opening parts of the shaft irregularly in the direction perpendicular to the radial direction of the shaft to show a zigzag effect of the cosmetic applicator brush, and wherein the cosmetic applicator brush is configured to create an irregular alignment of lateral protrusions.

2. The cosmetic applicator brush according to claim 1, wherein each of bristles or combs has a projecting part, which are inserted into the plurality of columns with an equal distance or different distances among them.

3. The cosmetic applicator brush according to claim 1, wherein a certain portion of the circumference of the shaft does not have any opening parts and any columns.

4. The cosmetic applicator brush according to claim 1, wherein each of the plurality of columns does not have the same design.

5. The cosmetic applicator brush according to claim 1, further comprising:

a conical being located a top portion of the shaft.

6. The cosmetic applicator brush according to claim 1, wherein a top portion of the shaft is tapered toward the end of the shaft.

7. A cosmetic applicator brush comprising:

a plurality of columns, wherein the plurality of columns are stacked to form the cosmetic applicator such that the cosmetic applicator has a circular shape in a radial direction of the cosmetic applicator brush, each of the plurality of columns comprises bristles or combs, a size of each of the plurality of columns in a direction perpendicular to the radial direction of the cosmetic applicator brush is greater than a size of each of the plurality of columns in the radial direction of the cosmetic applicator brush, and the plurality of columns are stacked irregularly in the direction perpendicular to the radial direction of the cosmetic applicator brush to show a zigzag effect of the cosmetic applicator brush, and wherein the cosmetic applicator brush is configured to create an irregular alignment of lateral protrusions.

8. The cosmetic applicator brush according to claim 7, wherein each of bristles or combs has a projecting part, which are inserted into the plurality of columns with an equal distance or different distances among them.

9. The cosmetic applicator brush according to claim 7, wherein each of the plurality of columns does not have the same design.

10. The cosmetic applicator brush according to claim 7, further comprising:

a conical being located at a top portion of the cosmetic applicator brush.

11. The cosmetic applicator brush according to claim 7, wherein a top portion of the cosmetic applicator brush is tapered toward its end.

* * * * *